US005839828A

United States Patent [19]

Glanville

[11] Patent Number: 5,839,828

[45] Date of Patent: Nov. 24, 1998

[54] STATIC MIXER

[76] Inventor: Robert W. Glanville, 381 Metacom Ave., Bristol, R.I. 02809

[21] Appl. No.: 858,822

[22] Filed: May 19, 1997

Related U.S. Application Data

[60] Provisional application No. 60/018,002, May 20, 1996.

[51] Int. Cl.[6] ..... B01F 5/06

[52] U.S. Cl. ..... 366/340; 366/336; 138/40; 138/44

[58] Field of Search ..... 366/336, 337, 366/338, 340, 174.1, 175.2; 138/40, 42, 44

[56] References Cited

U.S. PATENT DOCUMENTS

| | | | |
|---|---|---|---|
| 864,196 | 8/1907 | Rollins | 138/40 |
| 1,248,058 | 11/1917 | Bailey | 138/40 |
| 1,406,398 | 2/1922 | Livingston | 138/40 |
| 1,605,401 | 11/1926 | Hamilton | 138/40 |
| 1,610,507 | 12/1926 | Foley | 138/40 |
| 1,689,446 | 10/1928 | Miller et al. | 366/338 |
| 3,750,710 | 8/1973 | Hayner | 138/40 |
| 4,190,910 | 3/1980 | Teglund et al. | 138/44 |
| 4,498,786 | 2/1985 | Ruscheweyh | 366/336 |
| 4,600,544 | 7/1986 | Mix | 366/337 |
| 4,806,288 | 2/1989 | Nowosinski et al. | 366/337 |
| 4,808,007 | 2/1989 | King | 366/336 |
| 4,884,894 | 12/1989 | Hashimoto et al. | 366/338 |
| 4,981,368 | 1/1991 | Smith | 366/340 |
| 5,330,267 | 7/1994 | Tauscher | 366/340 |

FOREIGN PATENT DOCUMENTS

| | | | |
|---|---|---|---|
| 1807922 | 6/1969 | Germany | 366/338 |
| 2430487 | 8/1975 | Germany | 366/340 |
| 24309 | 3/1914 | Norway | 366/337 |

*Primary Examiner*—Tony G. Soohoo
*Attorney, Agent, or Firm*—Robert J Doherty

[57] ABSTRACT

A static mixer which is adapted for disposition in a pipe having a fluid flow direction including a circumferential flange radially inwardly extending from the internal pipe surface and in turn having at least a pair of opposed flaps extending therefrom and inclined in the direction of the fluid flow.

8 Claims, 12 Drawing Sheets

STATIC MIXER

The benefits of applicant's Provisional Application Serial No. 60/018,002 filed May 20, 1996 are claimed.

BACKGROUND AND OBJECTS OF THE INVENTION

This invention relates to an improved fluid flow mixing device of the type wherein an element is placed within a fluid containment or transport vessel such as a circular pipe and in which mixing of the fluid passing therethrough is provided without motion or movement imparted to the element. Such mixers are known as static or motionless mixers. Examples of such mixers are set forth in the following U.S. patents: U.S. Pat. No. 3,652,061 patented Mar. 28, 1972; U.S. Pat. No. 4,034,965 patented Jul. 12, 1977; U.S. Pat. No. 4,072,296 patented Feb. 7, 1978; U.S. Pat. No. 4,498,786 patented Feb. 12, 1985; and U.S. Pat. No. 4,929,088 patented May 29, 1990.

Despite the existence of such suggested and actual forms of apparatus for static mixing of fluids, there is a continual need for efficient mixers of this general type and particularly a need for a mixer of this type in which species such as water treatment chemicals may be introduced to the fluid stream in conjunction with the mixing device to ensure quick and efficient mixing thereof within a short downstream travel path in an efficient, low cost and trouble-free manner.

This and other objects of the present invention has been provided for by a device of this general nature which utilizes an essentially circular flange which is adapted to be mounted internally with respect to the inside pipe diameter. The inner flange includes a central opening which is in turn provided with a pair of flaps inwardly radially extending and to some extent slightly bent in the direction of the fluid flow through the pipe. Such a device results in a combination of laminar and turbulent flow rather than flow characterized by the existence of vortices relied upon in prior art devices and particularly that shown in U.S. Pat. No. 4,929,088. The subject device may, however, operate to accomplish vortex shedding to achieve fast mixing. Such principles of vortex shedding are set forth on Pages 14–16 of Flow Measurement Engineering Handbook by R. W. Miller published by McGraw-Hill Book Co. and in an article entitled An Efficient Swimming Machine by Triantafyllou et al published in Scientific American, March 1995, Pages 64–70 copies of which are enclosed. In addition to the beneficial mixing accomplished by the subject device, pressure drop and, accordingly, flow rates, can be measured by the plate placement as well as species injected therethrough and thus beneficially positioned for mixing at a pressure drop location.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 1:
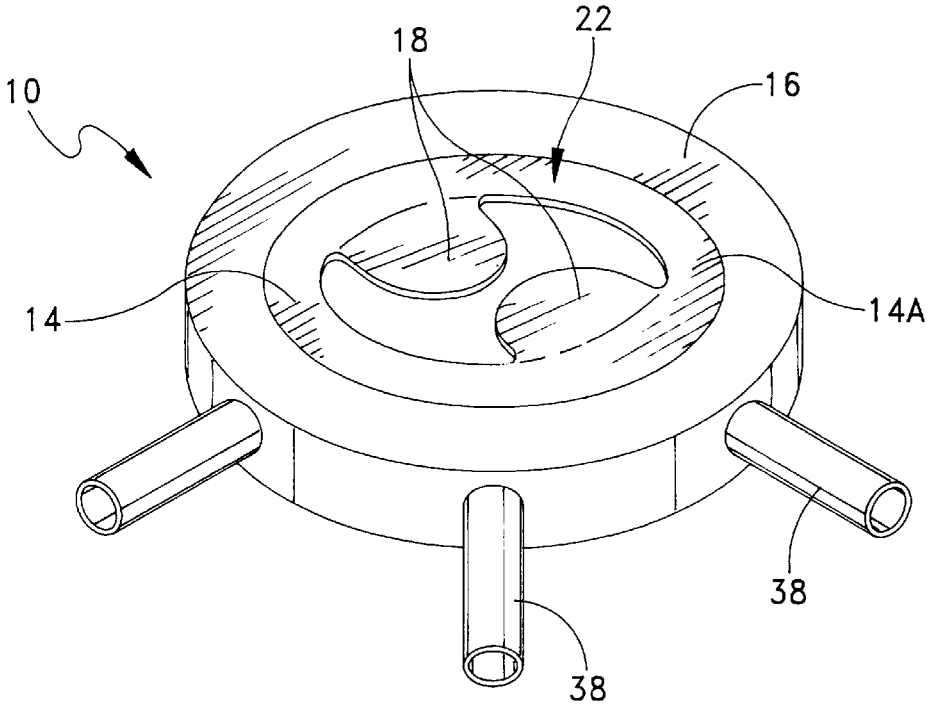
FIG. 1 is a perspective view of the device of the present invention attached to a plate in turn adapted for connection internally of a circular pipe and viewed from the upstream direction.
Figure 2:
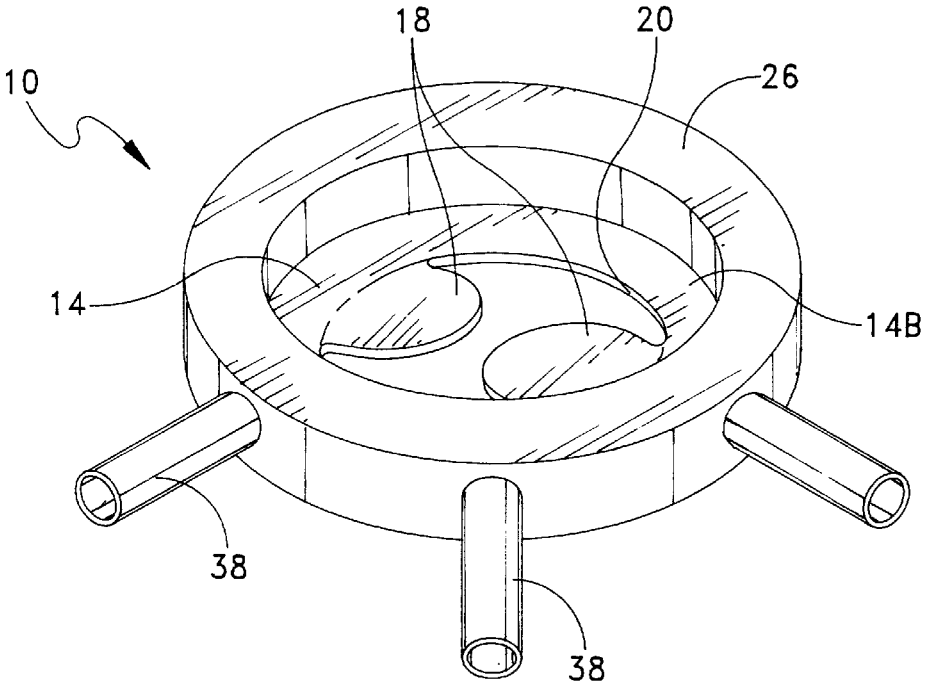
FIG. 2 is a view similar to FIG. 1 but viewed from the downstream direction.
Figure 4A:
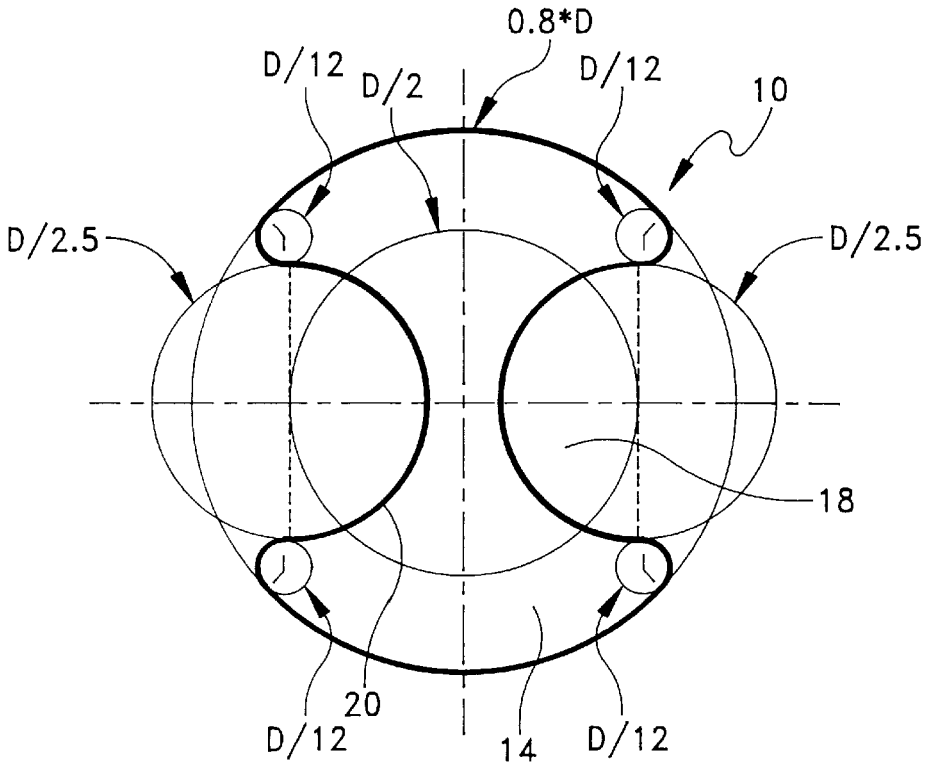
FIG. 4A is a view similar to FIG. 4 but stylized and showing the placement of a number of circles with their diameters expressed as a fraction of the pipeline internal diameter which circles and their placement define the shape of the preferred two-flap arrangement.
Figure 4:
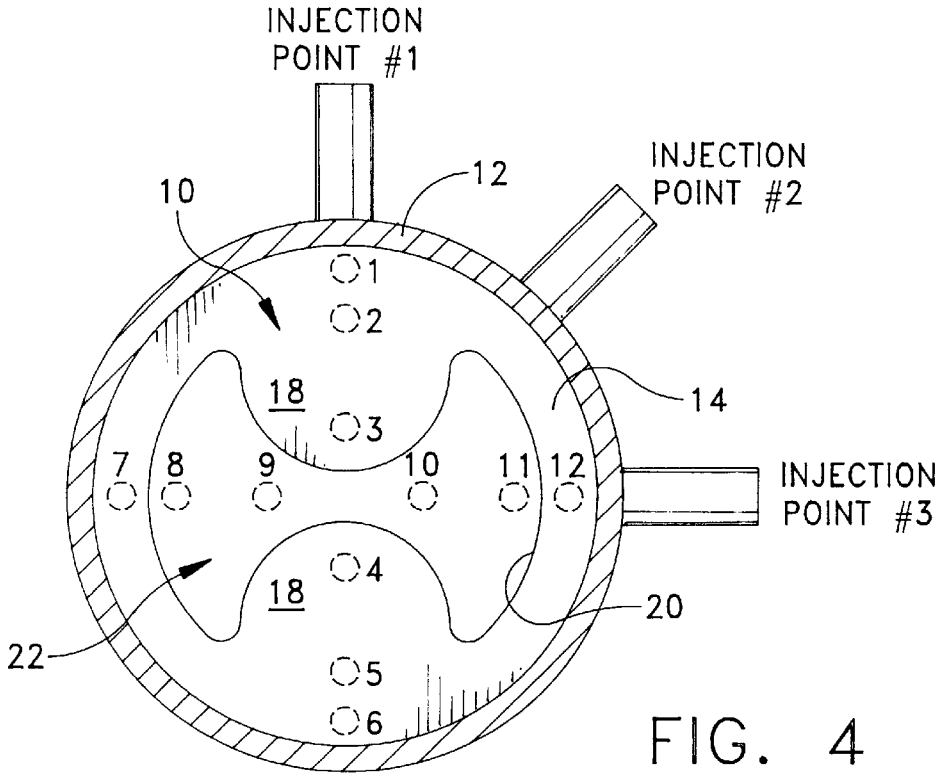
FIG. 4 is a sectional view taken along the line 4—4 of FIG. 3.
Figure 4B:
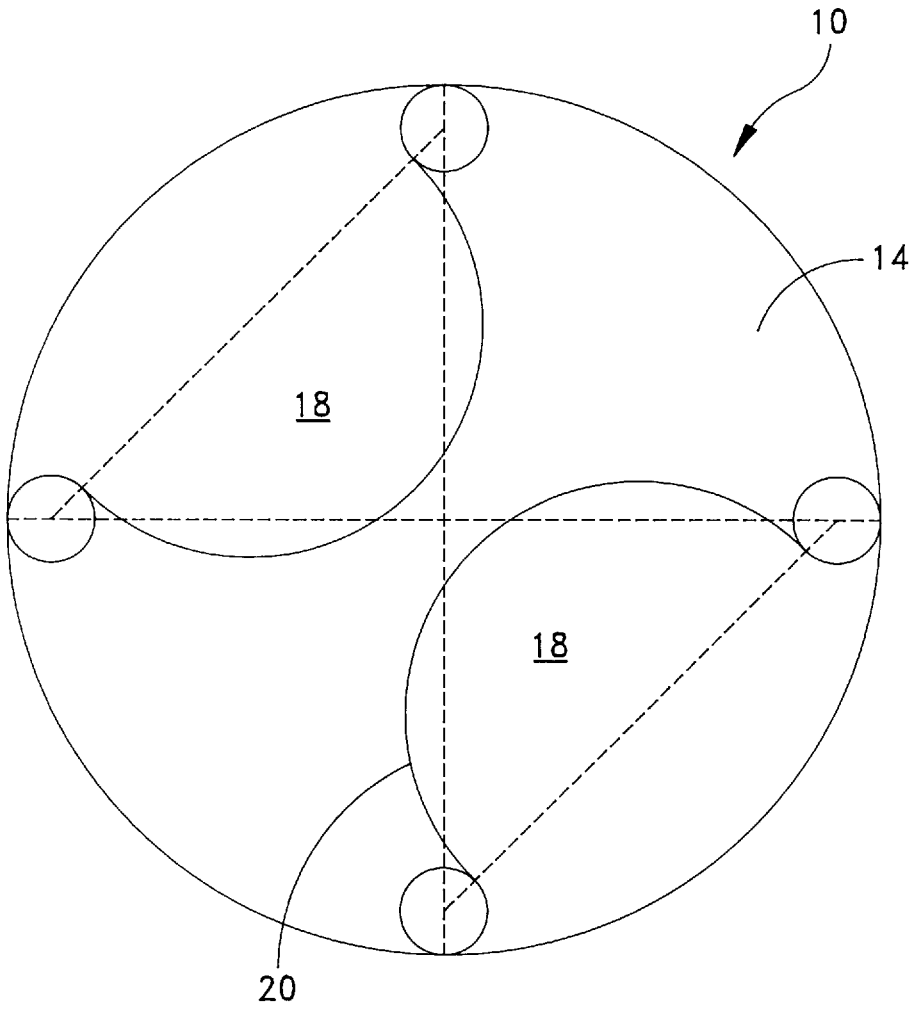
FIG. 4B is a view similar to FIG. 4A but more precisely defining preferred circle diameters mathematically rather than the close approximations of FIG. 4A.
Figure 7:
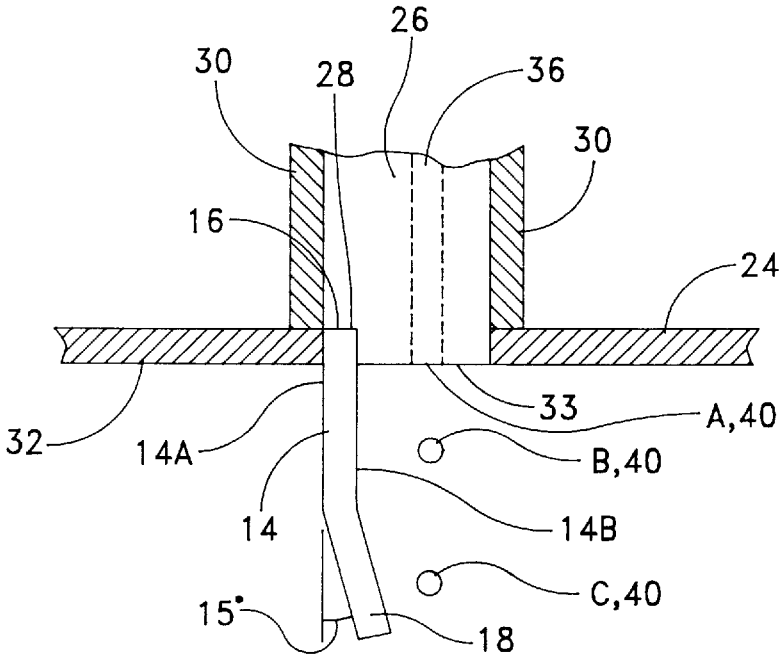
FIG. 7 is a partial cross-sectional view taken along the line 7—7 of FIG. 6.

Turning now to the drawings and particularly FIGS. 1 and 2 thereof, the device of the present invention is depicted. The device 10 is of an overall circular outside configuration, that is, a disc-like body 12 including an outside flange portion 14 extending inwardly from the outer periphery 16 of the disc 12 approximately one third of the radius of the entire disc 12 and a pair of radially opposed flaps 18 inwardly extending from the inner periphery 20 of such flange towards each other but not touching so as to form, in essence, a central open area 22 of a dumbbell-type configuration as best depicted in FIG. 4. The flange 14 includes flat opposed upstream and downstream surfaces 14A and 14B which project into the fluid stream, that is, portions of the fluid stream (generally the portions closer to the pipe wall) contact and, in effect, are diverted by surface 14A prior to passing through the central open area formed by the inner peripheral surface 20. In addition, the flaps 18 are bent downwardly inwardly towards the flow direction of the fluid through the pipe 24 in which the device 10 is mounted. Such mounting of the device 10 in the pipe 24 is accommodated by an outer plate 26 of cylindrical configuration and including a radially outwardly extending step 28 on the upstream side thereof such that the periphery 16 of the disc body may contact such step 28 and be held within the confines of the pipe 24 thereby. Pipe collars 30 may be provided at opposed ends of the pipe 24 to accommodate the insertion of the plate 26 therebetween and affixation thereto by bolts or other conventional means (not shown) passing through the plate and collars 26, 30 respectively. It should be pointed out that the internal diameter of the pipe 24, that is, the internal pipe surface 32 through which the fluid flows, is such that the inside peripheral surface 33 of the plate 26 as best shown in FIG. 7 forms a continuation of the internal pipe surface 32 of the pipe 24. It will also be apparent from this and other drawings that the flaps preferably 18 as well as the flange 14 extend inwardly into the fluid flow and that additionally the flaps extend at an angular relationship to such internal pipe or wall surface of approximately 15 degrees in the downstream direction but could even extend at angles of 25 or to 40 degrees. Preferably, the configuration of the flaps 18 is semi-elliptical or semi-circular such that defined open area 22 is entirely made up of rounded boundaries, that is, the areas where the flaps 18 meet the internal periphery 20 of the flange 14 are rounded.

Figure 5:
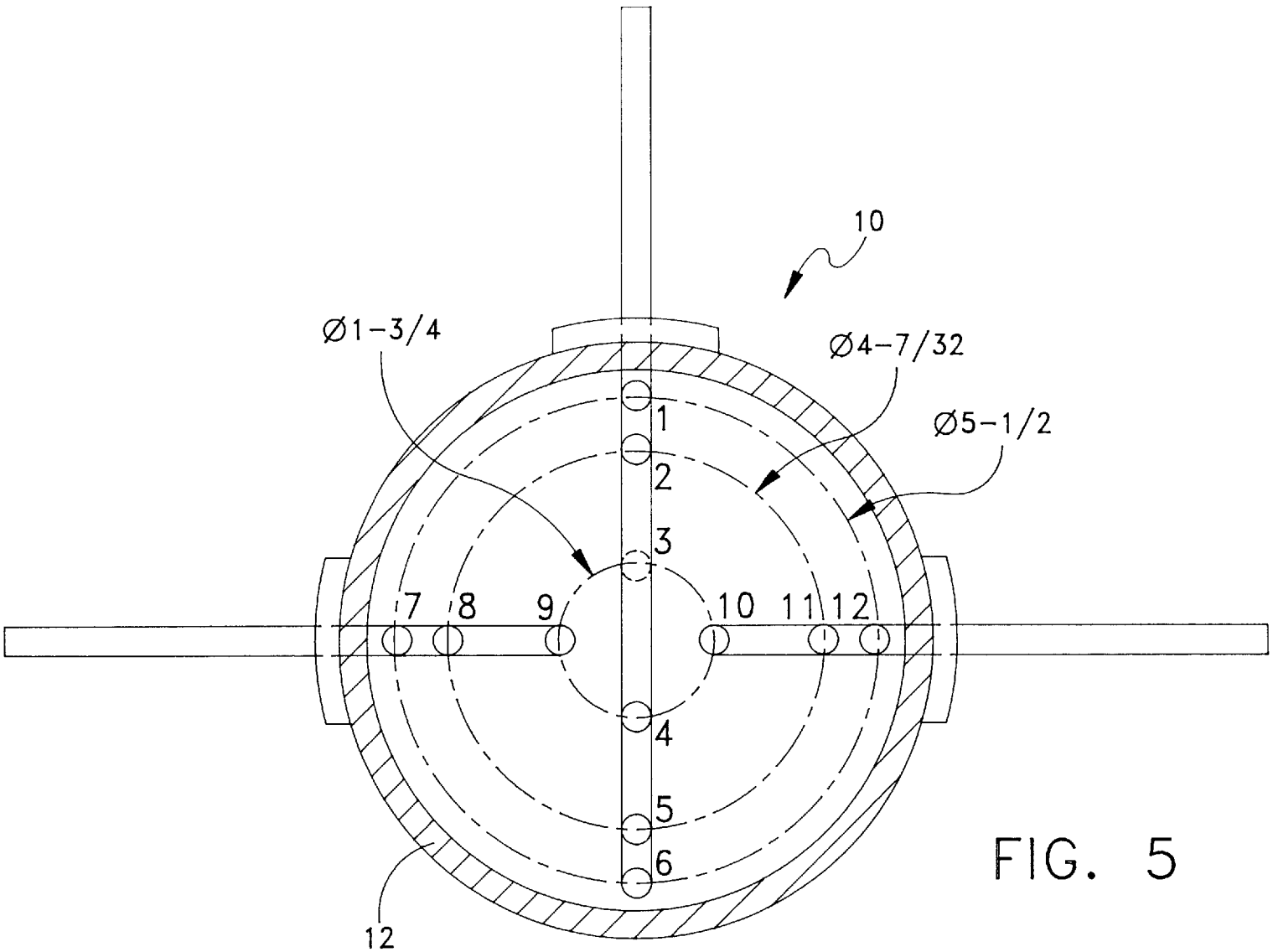
FIG. 5 is a sectional view taken along the line 5—5 of FIG. 3.
Figure 6:
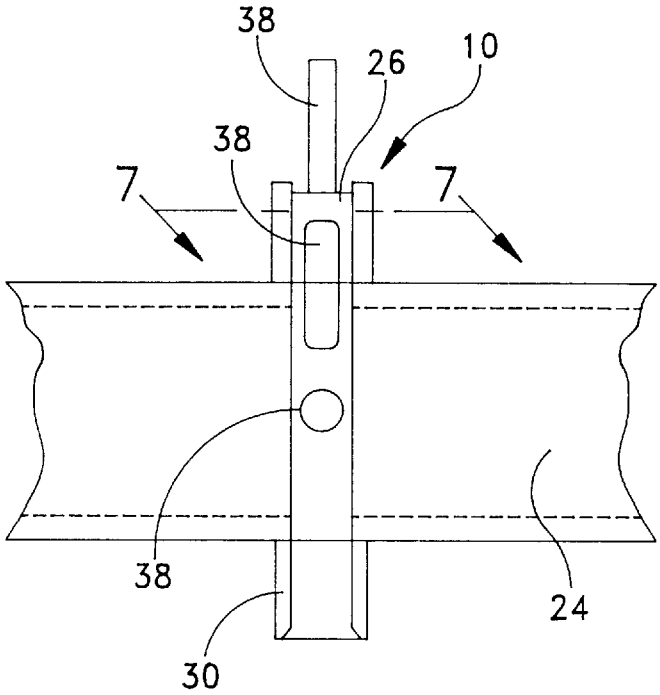
FIG. 6 is an enlarged partial elevational view of the mounted mixing device as shown in FIG. 3.

It is believed that the combination of the inwardly extending flange 14 and the flaps 18 enable an effective mixing to be achieved downstream of the disc body 12 by producing a combination of toroidal and turbulent flow and possibly by setting up overlapping vortices (vortex shedding) in the fluids. In addition, the presence of the flange 14 enables species material such as water treatment chemicals to be injected at various points immediately downstream of the flange, that is, adjacent thereto in a relatively non-turbulent fluid flow area since the injection points as best brought out by reference to FIGS. 4, 5 and 6, are positioned downstream of and adjacent either the flange 14 or the flaps 18. Water treatment species such as chlorine or similar materials may be introduced at such injection points A, B and C (which correspond to Injection Points #1, #2 and #3 in FIG. 4) through channels 36 provided in the plate 26 via pipes 38 such that a species material enters into the fluid flow stream via orifices 40. The injection points shown in the drawings correspond with an upper injection point A which is at the uppermost or top orientation of the device as shown in FIG. 4, a second injection point B shown at a 45° angle therefrom and a third injection point C at a 90° angle therefrom. It should be pointed out that these three injection points, although located within one quadrant of the disc, would presumably represent those same spacial locations within the other quadrants.

Figure 10:
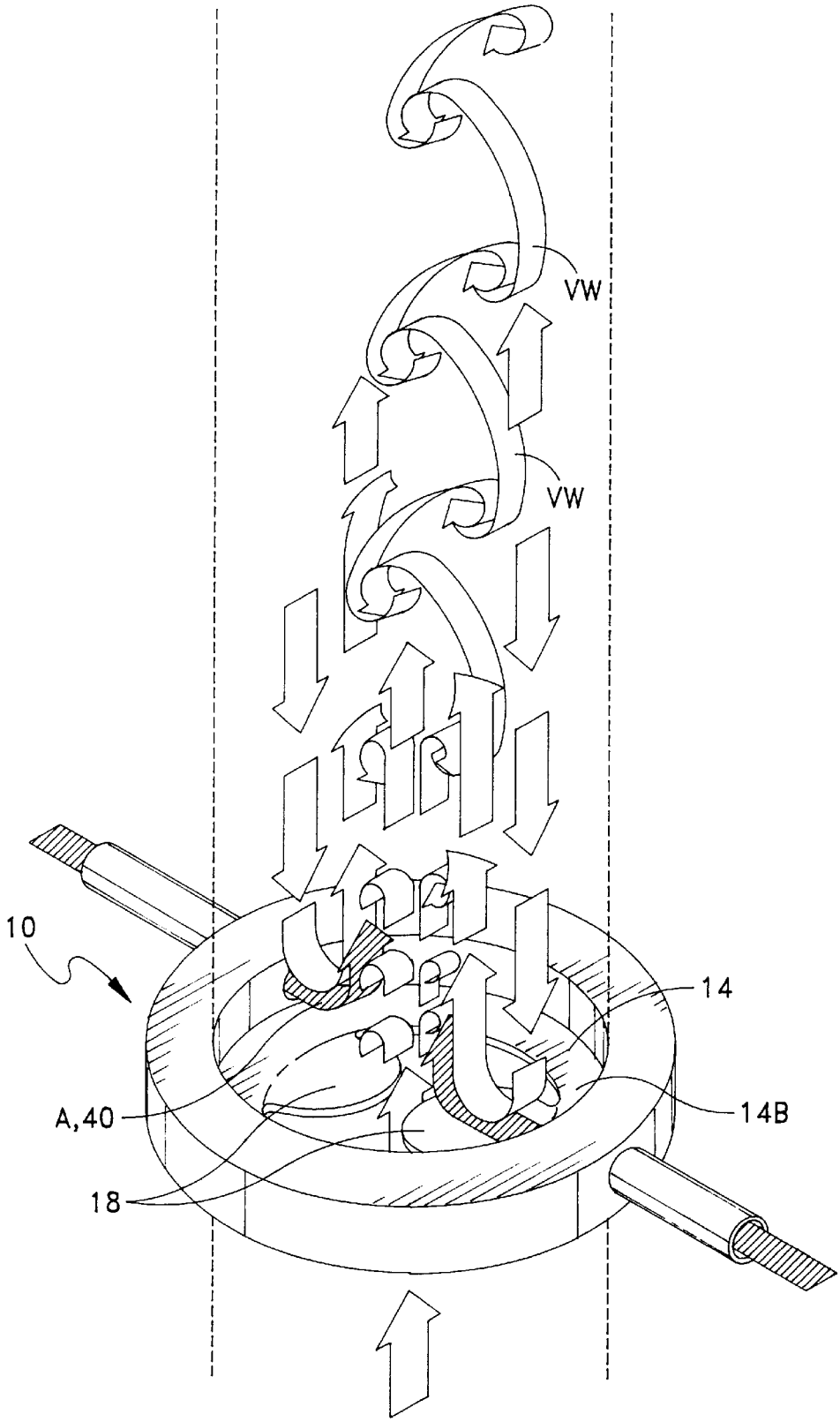
FIG. 10 is a stylized view of the mixing action from the double opposed flap version of the device as shown in FIGS. 1–7 depicting the presence of vortex whorls.
Figure 11:
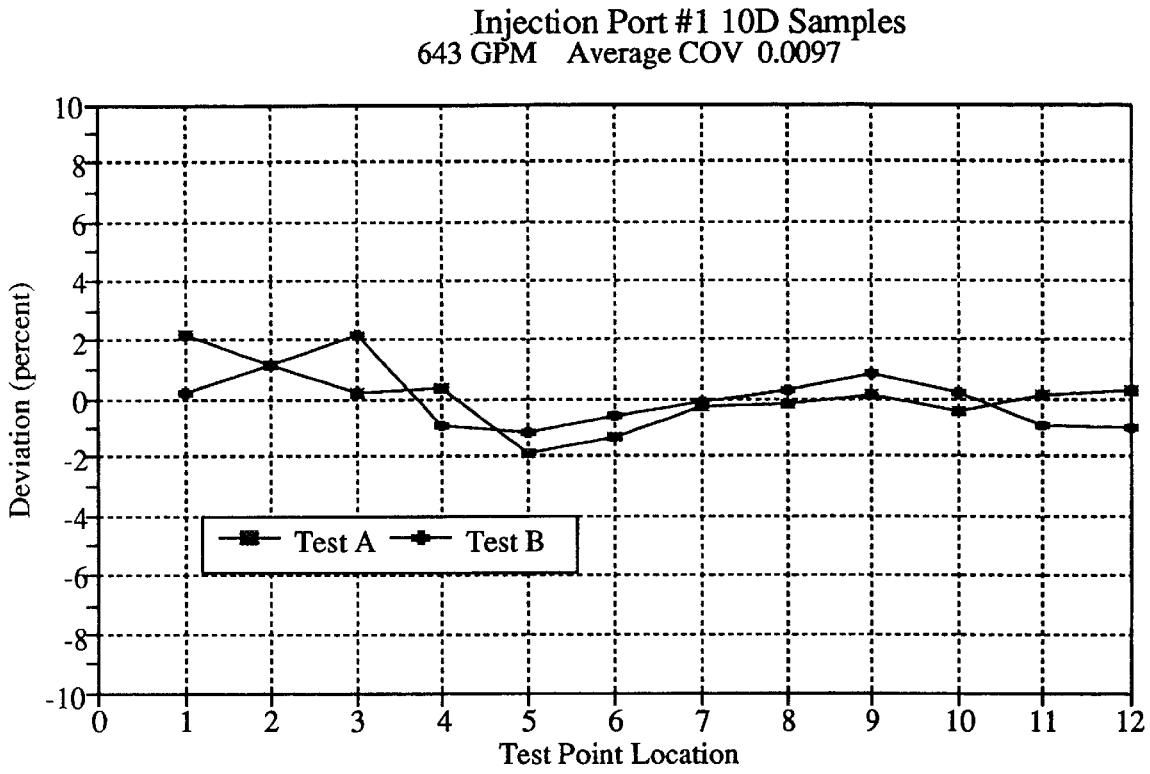
FIG. 11 is a graph showing mixing test results from species injection from port #1.
Figure 12:
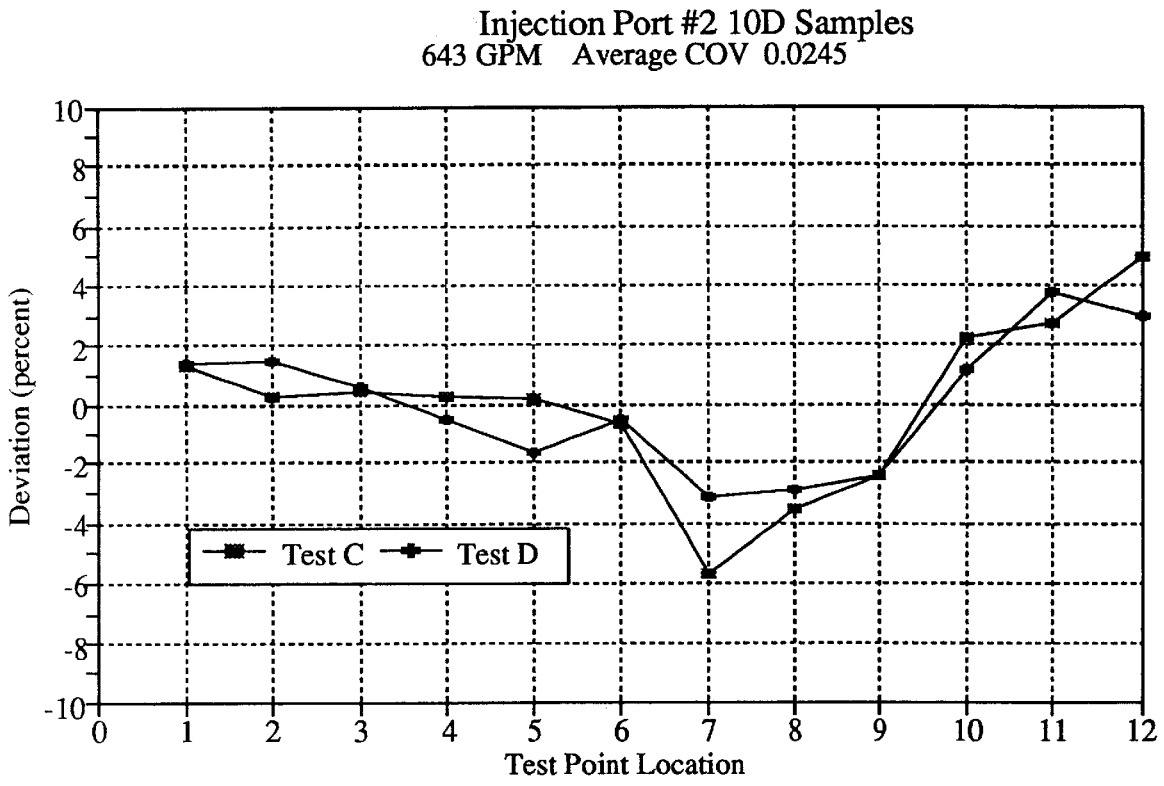
FIG. 12 is a graph showing mixing test results from species injection from port #2.
Figure 13:
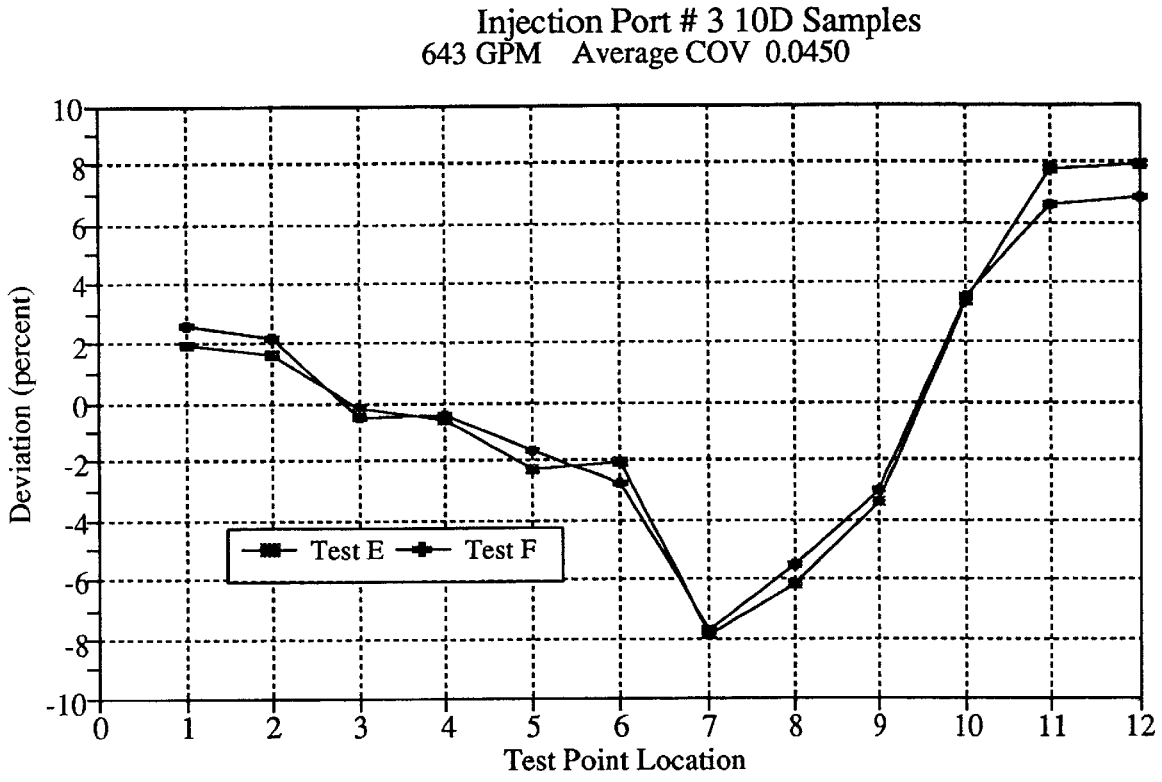
FIG. 13 is a graph showing mixing test results from species injection from port #3.

The disc body dimensions were slightly larger than six inches across in the test unit to be accommodated in the step 28 and the radial extent of the flange 14 is approximately 0.6 inches while the flaps extended radially inwardly approximately 2½ inches each towards each other. The disc body was composed of a stainless steel material but any material including engineered plastics that are resistant to whatever corrosive pressure affects might be present within the pipe 24 are suitable for the purpose but should have a capability of being suitably fabricated and a smooth outer surface such that the periphery of the open area 22 is also smooth. The various test results and the manner in which such test were conducted is set forth hereinafter in Pages 13 through 38, and it may be apparent therefrom that a highly effective mixing action is achieved in a very short distance by the device of the present invention when species is injected through injection port A and that less satisfactory results are achieved when ports B and C are utilized. Thus, it is apparent that the injection point (point A or #1) located in a generally centrally aligned position behind the flap 18 achieves the desired mixing result. Preferably the injection point or points is within a distance downstream of the device equal to about two to three times the pipe diameter and can be as shown immediately adjacent the device. Also and as illustrated by FIG. 10, the device forms alternating vortex whorls VW or vortex shedding rather than what is referred to as horseshoe vortices, and it is believed that this is in part responsible for the desired rapid lateral transfer and mixing of injected materials (usually fluids). This desired alternate vortex shedding (overlapping vortices) is definitely accomplished when the flap separation distance was 25% of the flap width. Of course, the size and width of the flaps and thus their spacing from each other differs with varying pipe diameters as calculated by the formulae shown in FIG. 4A.

Figure 8:
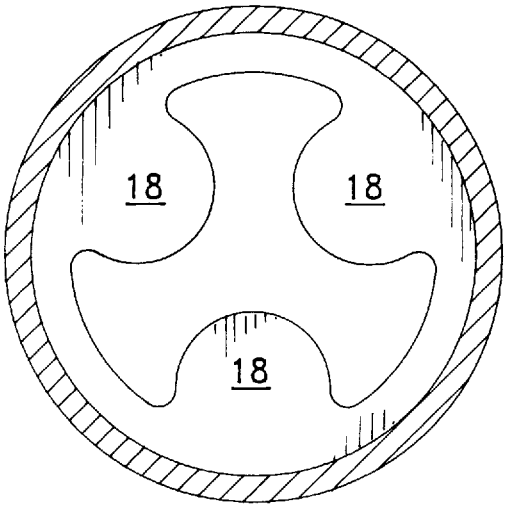
FIGS. 8 and 9 are elevational views of modified forms of the device wherein three and four flaps are respectively utilized.
Figure 9:
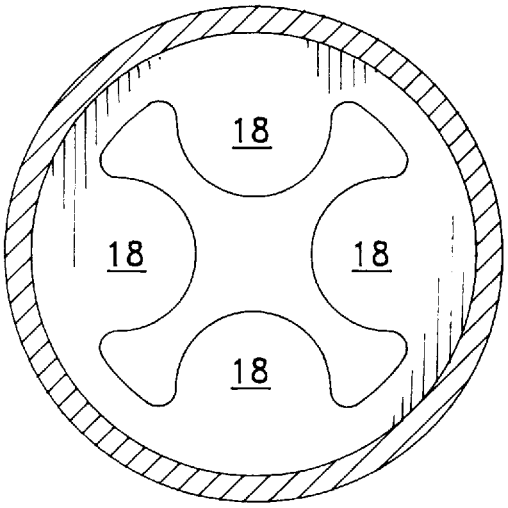

Obviously an injection point equivalent to injection point A or #1 centrally positioned behind the other flap 18 would achieve the same desired results. Also, it should be pointed out and this is especially so when dealing with larger pipe diameters that more than two opposed flaps 18 may be utilized and that the flaps do not necessarily have to be positioned in opposed pairs but that an odd number of flaps may be utilized. FIG. 8 shows a device wherein three flaps 18*a* are present, and FIG. 9 shows a device wherein four flaps 18*b* are present.

EXAMPLES

A 6" static mixing device was tested at the Alden Research Laboratory, Inc. for Westfall Manufacturing Company under their Purchase Order Number 11095 using ARL's standard test procedures, QA-AGF-7-86 Revision 3. The purpose of the testing was to define the mixing effectiveness of the device and to determine the overall head loss. The static mixer consisted of a shaped orifice plate and three injection ports spaced 45 degrees radially, as shown in FIG. 1.

STATIC MIXER INSTALLATION

Figure 3:
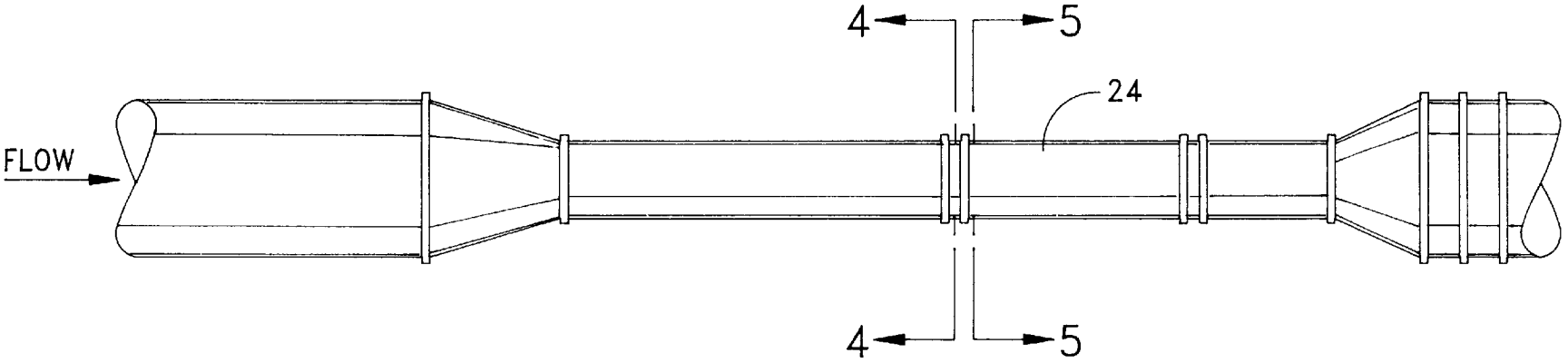
FIG. 3 is an elevational view of a test installation showing the device of the present invention mounted for mixing and species addition.

The static mixer was installed in Test Line 2 in Building 2. Water was provided through a 40" penstock from the main laboratory pond resulting in a gross gravity head of approximately 18 feet which was sufficient to obtain the flow required. The detailed piping arrangement, immediately upstream and downstream of the static mixer, is shown in FIG. 3 including pressure tap and sample locations. Careful attention was given to aligning the model static mixer with the test line piping and to assure no gaskets between flanged sections protruded into the flow. Vents were provided at critical locations of the test line to purge the system of air.

MIXING MEASUREMENT

Sample Locations

Mixing effectiveness was measured by determining the relative concentration of a fluorescent tracer at vertical planes 5 and 10 pipe diameters downstream of the mixer the (ten diameter location is shown on FIG. 3). The tracer used for concentration measurements was a fluorescent dye, Rhodamine WT. Spatial distribution of tracer concentration was measured at twelve locations on two diameters. The sample locations were located in the center of three annuli having equal areas shown in FIG. 5. A continuous flow was withdrawn from each location through individual tubes having control valves and free jet discharge. Twelve 250 ml bottles were installed on a rack which was slid under the discharge jet of the sample lines to obtain simultaneous samples from all locations. The sample flows were approximately equal, and a one minute average sample was taken at each position.

Concentration Measurement

A Turner Designs Model 10 fluorometer evaluated dye concentrations. The fluorometer was capable of detecting concentrations of about 0.01 ppb such that a mixed concentration of less than 10 ppb provided sufficient measurement accuracy while maintaining a concentration sufficiently low to be undetectable by eye. Concentration of the samples was determined by fluorescence intensity measurements.

Rhodamine WT has low adsorption characteristics and is supplied at nominal 20 percent concentration by weight. A stock injection solution was prepared by dilution of the supplied solution with distilled water. Only comparative concentration measurements were required, and the true stock solution concentration need not be known to attain good measurement accuracy. The mixed concentration at the sampling location, ranging from 5 to 10 ppb, assured sufficient measurement accuracy in the linear response region of the fluorometer response. Fluorescence is a function of water temperature, and sample temperature variations from the water temperature during calibration are accounted for by Equation (1) as follows:

$$C=C_r e\ k(T_r-T_c) \tag{1}$$

where

C=concentration (ppb)

$C_r$=apparent concentration at temperature $T_r$ (ppb)

$T_c$=calibration temperature (F)

$T_r$=temperature of sample (F)

k=temperature correction coefficient (1/F)

The temperature coefficient, k, used was 0.01444/F which is a standard value for Rhodamine WT and has been verified at ARL.

Instrumentation Description

The Turner Designs Model 10 fluorometer, used to measure dye concentration, has multiple ranges to increase the range of measurable concentrations. Two range settings are available, X1 and X100 having a 100 to 1 effect on output. Within each range, the sensitivity may be changed from X1 to X31.6 in four equal steps, having a maximum 30-fold effect on output. The instrument span and zero offset are also adjustable to match the output to the measured concentration. The fluorometer was set up to read in the upper one third of the output of the X1 sensitivity scale on the X1 range to ensure good resolution for a wide concentration range.

Fluorometer voltage output and two RTD thermometers, measuring water and instrument temperatures, were recorded by a portable computer with a 12 bit analog to digital converter. A platinum resistance temperature sensor, mounted in a ⅛" diameter rod, measured the water sample temperature which was used to correct measured fluorometer voltage output to calibration water temperature with Equation (1). Fluorometer output, water temperature and filter temperature were read at eight hertz and after 80 readings (about 10 seconds), the averages and standard deviations were calculated, stored and printed. During data acquisitions, individual temperature and fluorometer readings were displayed on the PC monitor for evaluation. Average fluorometer output, corrected to the calibration temperature, was also displayed versus time. Variation of the corrected output from from the previous test point was displayed as a percent to show trends on a magnified scale. After the fluorometer output reached a steady value and sufficient data were recorded for each sample, several 10 second readings at a given location were averaged for concentration calculation.

Dye Injection Method

Primary stock dye solution flow was about 1 ml/sec, so the dye solution was injected into a transport flow by a constant displacement pump whose variable stroke controlled the dye release to achieve a mixed concentration of between 5 and 10 ppb. The injection pump and a 100 ml pipette with reduced area measuring stations were supplied from a 20 liter Mariotte vessel (a vessel which maintains a constant inlet pressure on the injection pump regardless of liquid level in the vessel). Dye injection flow was constant for each test and was measured by the volumetric method. When the supply line from the Mariotte vessel was shut off via a valve, dye was supplied to the pump solely from the pipette which is a Class A vessel having a volume uncertainty of 0.1 percent. A digital timer with 0.001 sec resolution was started and stopped as the meniscus of the dye passed the measuring locations on the pipette. A rotameter was used to measure the transport flow which was set at 0.5 percent of the total flow.

HEAD LOSS MEASUREMENT

To measure the static mixer head loss, pairs of pressure taps were installed at each of two sections: one pipe diameter upstream and ten pipe diameters downstream of the mixer. The taps at each section were manifolded together to obtain a physical average. A differential pressure transducer with a span of 250 inches of water was used to measure the head loss using a PC based data acquisition system. The transducer and data acquisition system were calibrated with a pneumatic dead weight tester having an accuracy of 0.02 percent. Pressure data were averaged over a minimum of 150 seconds to obtain a precise average while the flow was measured by the gravimetric method.

FLOW MEASUREMENT METHODS

Flow was measured by the gravimetric method using a tank mounted on Fairbanks scales having a capacity of 50,000 pounds (resolution 5 lb). Water flowing through the primary element was diverted into the tank with an electrically operated knife edge passing through a rectangular jet produced by a diverter head box. A Hewlett-Packard"5301A" 10 MHz Frequency Counter (resolution 0.001 sec), activated by an optical switch on the knife edge, determined the time of diversion. A thermistor thermometer measured the water temperature to allow calculations of the water specific weight. The volumetric flow rate was calculated by Equation (2) as follows:

$$q_a=\frac{W}{T\gamma} \tag{2}$$

where $q_a$=volumetric flow, $ft^3$/sec

W=net accumulated weight, lbs

T=diversion time, sec

γ=water specific weight at run temperature, corrected for buoyancy, lbs/$ft^3$

The weight tank is periodically calibrated with 10,000 lbs of weights, the calibration of which is traceable to NIST. A computer is used to calculate flow rate from the raw data to assure consistency. Weight tank calibrations and the specific weight of water as a function of temperature are stored on disk file. Data were recorded manually and on disk file for later review and reporting. As an option, flow may be expressed in many different units as required by the application of standard conversions.

A head loss coefficient was defined as the head loss in feet of water divided by the velocity head. Above a pipe Reynolds number of about 100,000 the head loss coefficient is constant and may be used to calculate head losses versus flow.

$$K_1=(q_a/a_p)^2/(2g)$$

where $a_p$=area pipe, $ft^2$ g=local gravitational constant, 32.1625 $ft^2$/sec

TEST PROCEDURE

After checking the installation, water was introduced into the system to equalize line and model temperature to water temperature. Vent valves in the test line were opened to remove air from the system. Prior to a test run, the control valve was set to establish the desired total flow. The injection flow was set at the desired value (about 0.5 percent of the total flow) and the dye injection initiated. Initially, flow was diverted away from the weigh tank. After steady state conditions in the test line had been reached, in about five minutes, the weigh tank discharge valve was closed and the weigh tank scale indicator and the electric timer were both zeroed. The flow was then diverted into the weigh tank which automatically started the timer. During the collection time, the 250 ml sample bottles were filled. At the end of the end of the run, flow was diverted away from the weigh tank and the timer was stopped to terminate the test run. The weight of water in the tank, elapsed time and water temperature were recorded. The concentrations of the 12 samples were determined immediately after each test which analysis required about one hour.

TEST RESULTS

Spacial distribution of concentration was measured for each of the injection ports. Two tests were conducted at each flow for tests at the 10 diameter spacing to obtain an estimate of measurement precision. Table 1 lists the measured parameters for each test including the identification letter, transport flow in gpm, total flow in gpm, dye injection flow in ml/sec and coefficient of variation.

TABLE 1

Test Condition Summary

| Test | Injection Port | Injection Flow gpm | Total Flow gpm | Coefficient of Variation |
|---|---|---|---|---|
| A | 1 | 3.2 | 643 | 0.0099 |
| B | 1 | 3.2 | 643 | 0.0095 |
| C | 2 | 3.2 | 643 | 0.0274 |
| D | 2 | 3.2 | 643 | 0.0215 |
| E | 3 | 3.2 | 643 | 0.0468 |
| F | 3 | 3.2 | 643 | 0.0433 |
| G | 1 | 3.2 | 643 | 0.042 |
| H | 2 | 3.2 | 643 | 0.182 |
| I | 3 | 3.2 | 643 | 0.249 |

Concentration measurements for each injection port and the two sample locations are listed in Tables 2 through 7. Since the response of the fluorometer is linear with concentration, sample voltage minus background voltage is directly proportional to concentration. Measured voltages are listed for each location, and the relative concentration at the downstream locations is calculated as the voltage minus the average background voltage. The deviation of each relative concentration from the mean of the twelve readings is listed as percent of the mean of the twelve concentrations. Percent deviation is plotted versus the measurement position number (see FIG. 5) for each test in FIGS. 11 through 14. For the 10D sample locations, two tests were conducted for each injection location to evaluate data scatter. Typical data scatter was less than 1 percent and the maximum was about 2 percent. The coefficient of variation (CoV), defined as the standard deviation of the concentrations at the twelve locations divided by the mean concentration, was calculated for each test and listed in Table 1.

Six tests were conducted with the sample position ten diameters downstream of the static mixer, two each for the three injection ports. For Port #1, the maximum deviation from the average was about 2 percent with a vertical gradient (points 1 through 6 in the direction of the injection port) from +2 percent at the injection side to −2 percent at the opposite side. The concentration variation across the other diameter (perpendicular to the injection direction in the center) was less than 1 percent. The coefficient of variation averaged 0.0097. Port #2 was at 45 degrees to the horizontal and resulted in larger deviations. The samples on the vertical diameter had slightly less concentration variation, but on the horizontal diameter the variations were from +5 percent at the injection side to −6 percent with an average coefficient of variation of about 0.0245. The horizontal injection port (#3) had the largest deviations, with the horizontal diameter (in the direction of the injection) having variations of ±8 percent and a coefficient of variation of 0.045.

Figure 14:
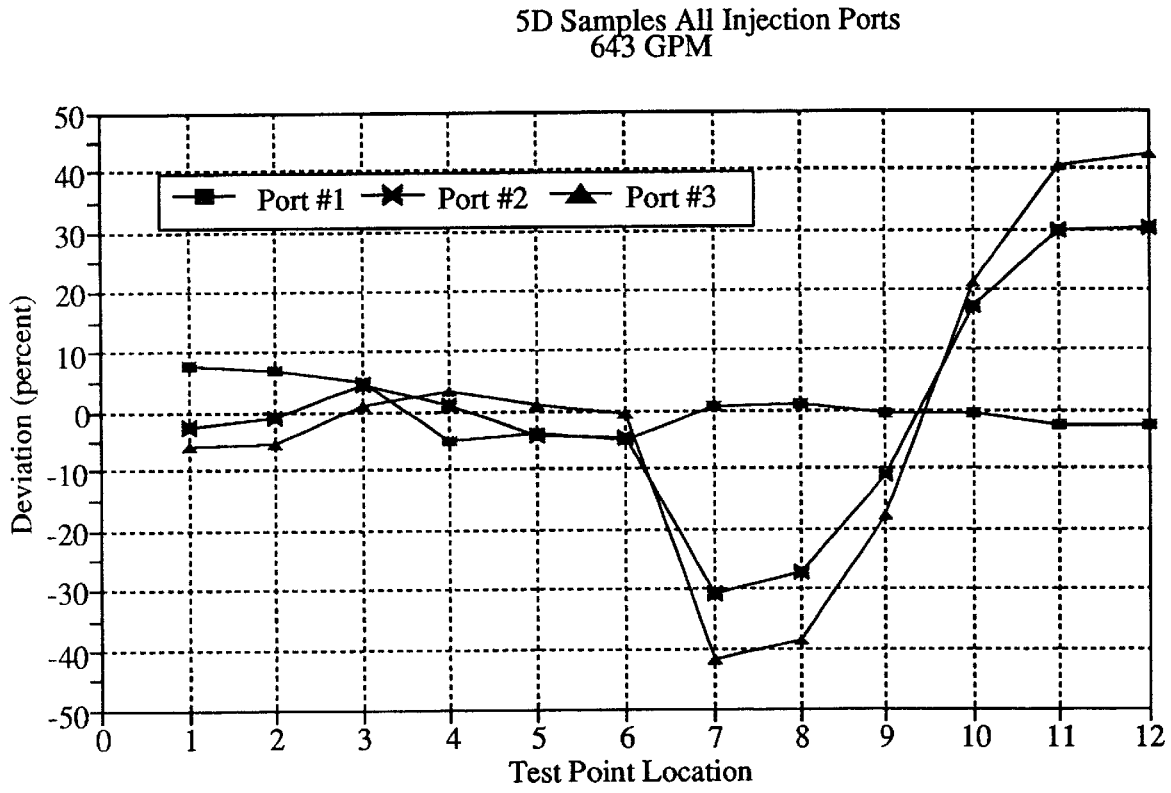
FIG. 14 is a graph showing the deviations for all three of the injection locations of FIGS. 11 through 13.

The sample ports were moved to five diameters downstream of the mixer and tests conducted with each injection port. Performance degraded in all cases. Port #1 (vertical) had the best performance with a maximum deviation of about +7.7 percent at top sample location. The coefficient of variation increased to 0.042 from the 0.0099 at 10D. The other two ports had very large horizontal gradients, a maximum of 40 percent deviations and coefficient of variations of 18.2 percent and 24.9 percent for Ports #2 and #3. FIG. 14 plots the deviations for all three injection locations.

Head loss was measured over a range of flow from 440 gpm to 636 gpm to obtain sufficiently large differential heads to provide good measurement accuracy. The pipe head loss without the static mixer was measured over a range of flows to allow calculation of the net head loss due to the mixer. Such pipe loss test data was used to calculate head loss for the mixer head loss tests. The static mixer head loss was characterized by a loss coefficient which was defined as the measured differential head divided by the velocity head in accordance with generally accepted engineering practices. The average loss coefficient for the tests was on the order of 13.63.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described.

TABLE 2

Westfall Mixing Tests
Injection Port #1
Sample at 10 D, 643 GPM

| Location | Test A Output Voltage | Background Concentration | Relative Concentration | Deviation Percent |
|---|---|---|---|---|
| 1 | 1.0450 | 0.0363 | 1.0087 | 2.15 |
| 2 | 1.0345 | 0.0363 | 0.9982 | 1.09 |

TABLE 2-continued

Westfall Mixing Tests
Injection Port #1
Sample at 10 D, 643 GPM

| | | | | |
|---|---|---|---|---|
| 3 | 1.0256 | 0.0363 | 0.9893 | 0.19 |
| 4 | 1.0270 | 0.0363 | 0.9907 | 0.33 |
| 5 | 1.0050 | 0.0363 | 0.9687 | −1.90 |
| 6 | 1.0108 | 0.0363 | 0.9745 | −1.31 |
| 7 | 1.0202 | 0.0363 | 0.9839 | −0.36 |
| 8 | 1.0218 | 0.0363 | 0.9855 | −0.19 |
| 9 | 1.0249 | 0.0363 | 0.9886 | 0.12 |
| 10 | 1.0197 | 0.0363 | 0.9834 | −0.41 |
| 11 | 1.0242 | 0.0363 | 0.9879 | 0.05 |
| 12 | 1.0260 | 0.0363 | 0.9897 | 0.23 |
| | Average | 0.0363 | 0.9874 | |
| | Standard Deviation | | 0.0097 | 0.987 |
| CoV | 0.0099 | | | |

| Location | Test B Output Voltage | Background Concentration | Relative Concentration | Deviation Percent |
|---|---|---|---|---|
| 1 | 0.9939 | 0.0341 | 0.9598 | 0.19 |
| 2 | 1.0032 | 0.0341 | 0.9691 | 1.16 |
| 3 | 1.0124 | 0.0341 | 0.9783 | 2.12 |
| 4 | 0.9831 | 0.0341 | 0.9490 | −0.94 |
| 5 | 0.9813 | 0.0341 | 0.9472 | −1.13 |
| 6 | 0.9864 | 0.0341 | 0.9523 | −0.60 |
| 7 | 0.9912 | 0.0341 | 0.9571 | −0.09 |
| 8 | 0.9949 | 0.0341 | 0.9608 | 0.29 |
| 9 | 0.9995 | 0.0341 | 0.9654 | 0.77 |
| 10 | 0.9935 | 0.0341 | 0.9594 | 0.15 |
| 11 | 0.9835 | 0.0341 | 0.9494 | −0.90 |
| 12 | 0.9824 | 0.0341 | 0.9483 | −1.01 |
| | Average | 0.0341 | 0.9580 | |
| | Standard Deviation | | 0.0091 | 0.954 |
| CoV | 0.0095 | | | |
| | Average Coefficient of Variation | | | 0.0097 |

TABLE 3

Westfall Mixing Tests
Injection Port #2
Sample at 10 D, 643 GPM

| Location | Test C Output Voltage | Background Concentration | Relative Concentration | Deviation Percent |
|---|---|---|---|---|
| 1 | 1.0358 | 0.0355 | 1.0003 | 1.32 |
| 2 | 1.0258 | 0.0355 | 0.9903 | 0.31 |
| 3 | 1.0270 | 0.0355 | 0.9915 | 0.43 |
| 4 | 1.0251 | 0.0355 | 0.9896 | 0.23 |
| 5 | 1.0243 | 0.0355 | 0.9888 | 0.15 |
| 6 | 1.0159 | 0.0355 | 0.9804 | −0.70 |
| 7 | 0.9668 | 0.0355 | 0.9313 | −5.67 |
| 8 | 0.9878 | 0.0355 | 0.9523 | −3.54 |
| 9 | 0.9986 | 0.0355 | 0.9631 | −2.45 |
| 10 | 1.0448 | 0.0355 | 1.0093 | 2.23 |
| 11 | 1.0498 | 0.0355 | 1.0143 | 2.74 |
| 12 | 1.0717 | 0.0355 | 1.0362 | 4.95 |
| | Average | 0.0355 | 0.9873 | |
| | Standard Deviation | | 0.0271 | |
| CoV | 0.0274 | | | |

| Location | Test D Output Voltage | Background Concentration | Relative Concentration | Deviation Percent |
|---|---|---|---|---|
| 1 | 1.0341 | 0.0370 | 0.9971 | 1.37 |
| 2 | 1.0344 | 0.0370 | 0.9974 | 1.40 |
| 3 | 1.0268 | 0.0370 | 0.9898 | 0.62 |
| 4 | 1.0152 | 0.0370 | 0.9782 | −0.55 |
| 5 | 1.0046 | 0.0370 | 0.9676 | −1.63 |
| 6 | 1.015 | 0.0370 | 0.9780 | −0.58 |
| 7 | 0.9902 | 0.0370 | 0.9532 | −3.10 |

TABLE 3-continued

Westfall Mixing Tests
Injection Port #2
Sample at 10 D, 643 GPM

| | | | | |
|---|---|---|---|---|
| 8 | 0.9921 | 0.0370 | 0.9551 | −2.90 |
| 9 | 0.9966 | 0.0370 | 0.9596 | −2.45 |
| 10 | 1.0317 | 0.0370 | 0.9947 | 1.12 |
| 11 | 1.0574 | 0.0370 | 1.0204 | 3.74 |
| 12 | 1.0498 | 0.0370 | 1.0128 | 2.96 |
| | Average | 0.0370 | 0.9837 | |
| | Standard Deviation | | 0.0212 | |
| CoV | 0.0215 | | | |
| | Average Coefficient of Variation | | | 0.0245 |

TABLE 4

Westfall Mixing Tests
Injection Port #3
Sample at 10 D, 643 GPM

| Location | Test E Output Voltage | Background Concentration | Relative Concentration | Deviation Percent |
|---|---|---|---|---|
| 1 | 1.0375 | 0.0344 | 1.0031 | 1.93 |
| 2 | 1.0342 | 0.0344 | 0.9998 | 1.60 |
| 3 | 1.0160 | 0.0344 | 0.9816 | −0.25 |
| 4 | 1.0120 | 0.0344 | 0.9776 | −0.66 |
| 5 | 0.9962 | 0.0344 | 0.9618 | −2.26 |
| 6 | 0.9982 | 0.0344 | 0.9638 | −2.06 |
| 7 | 0.9413 | 0.0344 | 0.9069 | −7.84 |
| 8 | 0.9576 | 0.0344 | 0.9232 | −6.19 |
| 9 | 0.9849 | 0.0344 | 0.9505 | −3.41 |
| 10 | 1.0517 | 0.0344 | 1.0173 | 3.38 |
| 11 | 1.0950 | 0.0344 | 1.0606 | 7.78 |
| 12 | 1.0970 | 0.0344 | 1.0626 | 7.98 |
| | Average | 0.0344 | 0.9841 | |
| | Standard Deviation | | 0.0461 | 4.683 |
| CoV | 0.0468 | | | |

| Location | Test F Output Voltage | Background Concentration | Relative Concentration | Deviation Percent |
|---|---|---|---|---|
| 1 | 1.0441 | 0.0356 | 1.0085 | 2.54 |
| 2 | 1.0406 | 0.0356 | 1.0050 | 2.18 |
| 3 | 1.0141 | 0.0356 | 0.9785 | −0.51 |
| 4 | 1.0148 | 0.0356 | 0.9792 | −0.44 |
| 5 | 1.0024 | 0.0356 | 0.9668 | −1.70 |
| 6 | 0.9918 | 0.0356 | 0.9562 | −2.78 |
| 7 | 0.9435 | 0.0356 | 0.9079 | −7.69 |
| 8 | 0.9648 | 0.0356 | 0.9292 | −5.53 |
| 9 | 0.9892 | 0.0356 | 0.9536 | −3.04 |
| 10 | 1.0532 | 0.0356 | 1.0176 | 3.46 |
| 11 | 1.0842 | 0.0356 | 1.0486 | 6.61 |
| 12 | 1.087 | 0.0356 | 1.0514 | 6.90 |
| | Average | 0.0356 | 0.9835 | |
| | Standard Deviation | | 0.0425 | 4.326 |
| CoV | 0.0433 | | | |
| | Average Coefficient of Variation | | | 0.0450 |

TABLE 5

Westfall Mixing Tests
Injection Port #1
Sample at 5 D, 643 GPM

| Location | Test G Output Voltage | Background Concentration | Relative Concentration | Deviation Percent |
|---|---|---|---|---|
| 1 | 1.0240 | 0.0348 | 0.9892 | 7.69 |
| 2 | 1.0154 | 0.0348 | 0.9806 | 6.75 |
| 3 | 0.9989 | 0.0348 | 0.9641 | 4.95 |

TABLE 5-continued

Westfall Mixing Tests
Injection Port #1
Sample at 5 D, 643 GPM

| Location | Test G Output Voltage | Background Concentration | Relative Concentration | Deviation Percent |
|---|---|---|---|---|
| 4 | 0.9066 | 0.0348 | 0.8718 | −5.09 |
| 5 | 0.9176 | 0.0348 | 0.8828 | −3.90 |
| 6 | 0.9077 | 0.0348 | 0.8729 | −4.97 |
| 7 | 0.9566 | 0.0348 | 0.9218 | 0.35 |
| 8 | 0.9615 | 0.0348 | 0.9267 | 0.88 |
| 9 | 0.9481 | 0.0348 | 0.9133 | −0.58 |
| 10 | 0.9483 | 0.0348 | 0.9135 | −0.55 |
| 11 | 0.9284 | 0.0348 | 0.8936 | −2.72 |
| 12 | 0.9276 | 0.0348 | 0.8928 | −2.81 |
| | Average | 0.0348 | 0.9186 | |
| | Standard Deviation | | 0.0386 | 4.202 |
| CoV | 0.0420 | | | |

TABLE 6

Westfall Mixing Tests
Injection Port #2
Sample at 5 D, 643 GPM

| Location | Test H Output Voltage | Background Concentration | Relative Concentration | Deviation Percent |
|---|---|---|---|---|
| 1 | 0.9385 | 0.0368 | 0.9017 | −2.47 |
| 2 | 0.9498 | 0.0368 | 0.9130 | −1.25 |
| 3 | 1.0013 | 0.0368 | 0.9645 | 4.32 |
| 4 | 0.9711 | 0.0368 | 0.9343 | 1.05 |
| 5 | 0.9218 | 0.0368 | 0.8850 | −4.28 |
| 6 | 0.9159 | 0.0368 | 0.8791 | −4.92 |
| 7 | 0.6748 | 0.0368 | 0.6380 | −31.00 |
| 8 | 0.7089 | 0.0368 | 0.6721 | −27.31 |
| 9 | 0.8580 | 0.0368 | 0.8212 | −11.18 |
| 10 | 1.1195 | 0.0368 | 1.0827 | 17.10 |
| 11 | 1.2357 | 0.0368 | 1.1989 | 29.67 |
| 12 | 1.2412 | 0.0368 | 1.2044 | 30.27 |
| | Average | 0.0368 | 0.9246 | |
| | Standard Deviation | | 0.1686 | 18.23 |
| CoV | 0.1823 | | | |

TABLE 7

Westfall Mixing Tests
Injection Port #3
Sample at 5 D, 643 GPM

| Location | Test I Output Voltage | Background Concentration | Relative Concentration | Deviation Percent |
|---|---|---|---|---|
| 1 | 0.9307 | 0.0347 | 0.8960 | −5.64 |
| 2 | 0.0353 | 0.0347 | 0.9006 | −5.16 |
| 3 | 0.9908 | 0.0347 | 0.9561 | 0.68 |
| 4 | 1.0180 | 0.0347 | 0.9833 | 3.55 |
| 5 | 0.9926 | 0.0347 | 0.9579 | 0.87 |
| 6 | 0.9777 | 0.0347 | 0.9430 | −0.70 |
| 7 | 0.5901 | 0.0347 | 0.5554 | −41.51 |
| 8 | 0.6198 | 0.0347 | 0.5851 | −38.38 |
| 9 | 0.8176 | 0.0347 | 0.7829 | −17.55 |
| 10 | 1.1841 | 0.0347 | 1.1494 | 21.04 |
| 11 | 1.3678 | 0.0347 | 1.3331 | 40.39 |
| 12 | 1.3871 | 0.0347 | 1.3524 | 42.42 |
| | Average | 0.0347 | 0.9496 | |
| | Standard Deviation | | 0.2366 | 24.92 |
| CoV | 0.2492 | | | |

I claim:

1. In combination with a hollow tubular conduit defining an internal longitudinal passageway wherein said conduit includes an internal wall surface, a static mixing device positioned in said conduit and within a fluid stream having a longitudinal flow direction within said passageway, comprising; a circular flange radially inwardly extending into said passageway at a generally normal angular relationship to said conduit internal wall surface, said flange having a central opening within the same plane as said flange for passage of said fluid stream therethrough and defined by an inner peripheral edge of said flange, said flange having a generally flat upstream surface for frictional abutting contact with said fluid stream prior to passing through said opening, said central opening in turn being inwardly spaced from said conduit internal wall surface a material distance in the order of approximately one third of the radius of said conduit, said device further including at least two opposed spaced apart flaps radially inwardly projecting from said flange and cooperatively forming said central opening with said flange inner peripheral edge and wherein said flaps are inclined at an angle to said internal wall surface in the direction of said fluid stream.

2. The device of claim 1, wherein four equidistantly spaced flaps are provided at said flange.

3. The device of claim 1, wherein three equidistantly spaced flaps are provided at said flange.

4. The device of claim 1, wherein at least one injection port is provided through said conduit on the downstream side of said flange and circumferentially disposed in general central alignment with one of said flaps.

5. The device of claim 4, wherein said at least one injection port is radially disposed at said internal wall surface.

6. The device of claim 1, wherein said central opening, said flange inner peripheral edge and said flaps are all defined by circumferential portions of circles of varying diameters and wherein said central opening is defined by a continuously rounded peripheral edge surface.

7. The device of claim 1, wherein the flaps are disposed at an angle of about 15°.

8. In combination with a hollow tubular conduit defining an internal longitudinal passageway wherein said conduit includes an internal wall surface, a static mixing device positioned in said conduit and within a fluid stream having a longitudinal flow direction within said passageway, comprising; a circular flange radially inwardly extending into said passageway at a generally normal angular relationship to said conduit internal wall surface, said flange having a central opening defined by an inner peripheral edge of said flange which in turn is inwardly spaced from said conduit internal wall surface for passage of said fluid stream therethrough, said device further including at least two opposed spaced apart flaps radially inwardly projecting from said flange and cooperatively forming said central opening with said flange inner peripheral edge and wherein said flaps are inclined at an angle to said internal wall surface in the direction of said fluid stream, wherein said central opening, said flange inner peripheral edge and said flaps are all defined by circumferential portions of circles of varying diameters and wherein said central opening is defined by a continuously rounded peripheral edge surface, wherein a pair of flaps are provided and said central opening is dumbbell shaped.

* * * * *